US007532845B2

(12) United States Patent
Gross et al.

(10) Patent No.: US 7,532,845 B2
(45) Date of Patent: May 12, 2009

(54) PAPER JAM-RESISTANT DETACK COROTRON FOR USE IN AN ELECTROSTATOGRAPHIC IMAGING APPARATUS

(75) Inventors: Robert Arnold Gross, Penfield, NY (US); David Sekovski, Rochester, NY (US); Douglas Arthur McKeown, Geneseo, NY (US); David Kenneth Ahl, Rochester, NY (US); Michael Nicholas Soures, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 381 days.

(21) Appl. No.: 11/375,645

(22) Filed: Mar. 14, 2006

(65) Prior Publication Data

US 2007/0217835 A1 Sep. 20, 2007

(51) Int. Cl.
*G03G 15/20* (2006.01)

(52) U.S. Cl. ..... 399/311; 399/315; 399/316

(58) Field of Classification Search ..... 399/170, 399/172, 173, 311, 315, 316; 250/324–326
See application file for complete search history.

(56) References Cited

U.S. PATENT DOCUMENTS

| | | | | |
|---|---|---|---|---|
| 3,831,933 | A | 8/1974 | Fantozzi | |
| 3,918,403 | A * | 11/1975 | Vock | 399/311 |
| 4,748,473 | A | 5/1988 | Tsuruoka | |
| 5,225,879 | A * | 7/1993 | Hayashida | 399/315 |
| 5,229,819 | A | 7/1993 | Beresniewicz et al. | |
| 5,381,216 | A * | 1/1995 | Osaka et al. | 399/315 |
| 7,457,573 | B2 * | 11/2008 | Tsujita | 399/315 |

* cited by examiner

*Primary Examiner*—David M Gray
*Assistant Examiner*—Laura K Roth
(74) *Attorney, Agent, or Firm*—Maginot, Moore & Beck LLP

(57) ABSTRACT

An improved detack corotron reduces the likelihood of a paper jam arising from a curled paper edge getting caught in the corotron. The detack corotron includes an electrically conductive coronode having a plurality of field emitters, each field emitter having a terminating end, the terminating ends of the field emitters being spatially separated from one another, and a paper edge guide having a plurality of generally planar members, the generally planar members being perpendicular to the conductive coronode and the generally planar members having a height that extends above the terminating ends of the field emitters.

13 Claims, 3 Drawing Sheets

PAPER JAM-RESISTANT DETACK COROTRON FOR USE IN AN ELECTROSTATOGRAPHIC IMAGING APPARATUS

CROSS-REFERENCE

Cross-reference is made to the co-pending patent application entitled "Corotron Pin Guard" having Ser. No. 11/265,478 that was filed on Nov. 2, 2005, which is assigned to the assignee of this application. This application is incorporated herein in its entirety.

BACKGROUND

This invention relates in general to an image forming apparatus and more particularly, to pin corona devices that are used for media sheet detacking in electrostatographic imaging systems.

An electrostatographic copying process includes exposing a substantially uniform charged photoreceptive member to a light image of an original document. This exposure selectively discharges areas of the charged photoreceptive member that correspond to non-image areas in the original document, while maintaining the charge in the areas corresponding to image content. Selectively discharging areas on the photoreceptive member generates an electrostatic latent image of the original document on the photoreceptive member. The electrostatic latent image is subsequently developed into a visible image by a process in which a charged developing material is deposited onto the photoconductive surface of the photoreceptor. The developing material is attracted to the charged image areas of the photoreceptive member and then the developing material conforming to the latent image is then transferred from the photoreceptive member to a media sheet. The media sheet is transported to a fusing station where the image may be permanently affixed to provide a reproduction of the original document. In a final step, the photoconductive surface of the photoreceptive member is cleaned to remove any residual developing material in preparation for another imaging cycle.

The electrostatographic process is useful for light lens copying from original images, as well as, for printing documents from electronically generated or stored original images. Analogous processes also exist in other electrostatographic applications, such as, for example, iconography where charge is selectively deposited on a charge retentive surface in accordance with an image stored in electronic form.

Electrostatographic imaging machines often use corona devices for charging a surface with electrostatic fields generated by the corona devices. Such corona devices are primarily used to deposit charge on the photoreceptive member prior to exposure to the light image described above. Corona devices may also be used in the transfer of an electrostatic image from a photoreceptor to a transfer substrate, in the tacking and detacking of paper sheets to or from the imaging member by applying a neutralizing charge to the paper, and, in the conditioning of the imaging surface prior to, during, and after deposition of toner on the imaging surface to improve the quality of the xerographic output copy.

A corona generating device, or corotron, typically includes a pin array having a plurality of electrostatic field emitters that terminate in pointed ends. A corotron is coupled to a source of high voltage so electrostatic fields are generated at the pointed tips in the pin array. If the corotron is in the vicinity of the media path in an electrostatographic imaging machine, a potential hazard is presented to an operator or technician when a media sheet jams the media path in the area of the corotrons. This hazard arises from the requirement to reach into the machine past one or more corotrons to remove the jammed sheet or sheets. For example, to clear a paper jam in some current machines, the transfer deck needs to be pivoted away from the photoreceptor to release the sheets for removal from the media path. Reaching into this area, however, may result in injury if the operator or technician contacts the pointed ends of a pin array. This injury risk is addressed by the safety guard structure disclosed in the co-pending patent application entitled "Corotron Pin Guard" having Ser. No. 11/265,478 that was filed on Nov. 2, 2005, which is assigned to the assignee of this application.

Another way to reduce the risk of injury is to reduce the likelihood of a paper jam caused in the vicinity of the corotrons so that an operator need not remove a paper jam. One cause of paper jams in the vicinity of a detack corotron arises from curled paper edges getting caught in the detack corotron. A leading or trailing edge of a paper sheet may curl away from the photoreceptor and get caught in the detack corotron as the detack corotron applies charge to the back of the paper sheet to help release the sheet from the photoreceptor. Additional causes for curled paper edges include environmental factors in the media sheet path such as heat and other conditions occurring in the machine.

SUMMARY

An improved detack corotron reduces the likelihood of a paper jam arising from a curled paper edge getting caught in the corotron. The detack corotron includes an electrically conductive coronode having a plurality of field emitters, each field emitter having a terminating end, the terminating ends of the field emitters being spatially separated from one another, and a paper edge guide having a plurality of generally planar members, the generally planar members being perpendicular to the conductive coronode and the generally planar members having a height that extends above the terminating ends of the field emitters. Such a detack corotron may be used in an electrostatographic machine to reduce the occurrence of paper jams at the detack corotron.

The term 'printer' or 'reproduction apparatus' as used herein broadly encompasses various printers, copiers or multifunction machines or systems, xerographic or otherwise, unless otherwise defined in a claim. The term 'sheet' herein refers to any flexible physical sheet or paper, plastic, or other useable physical substrate for printing images thereon, whether precut or initially web fed.

BRIEF DESCRIPTION OF THE DRAWINGS

Various features noted above and further features and advantages will be apparent to those skilled in the art from the specific embodiments, including the drawing figures.

Figure 1:
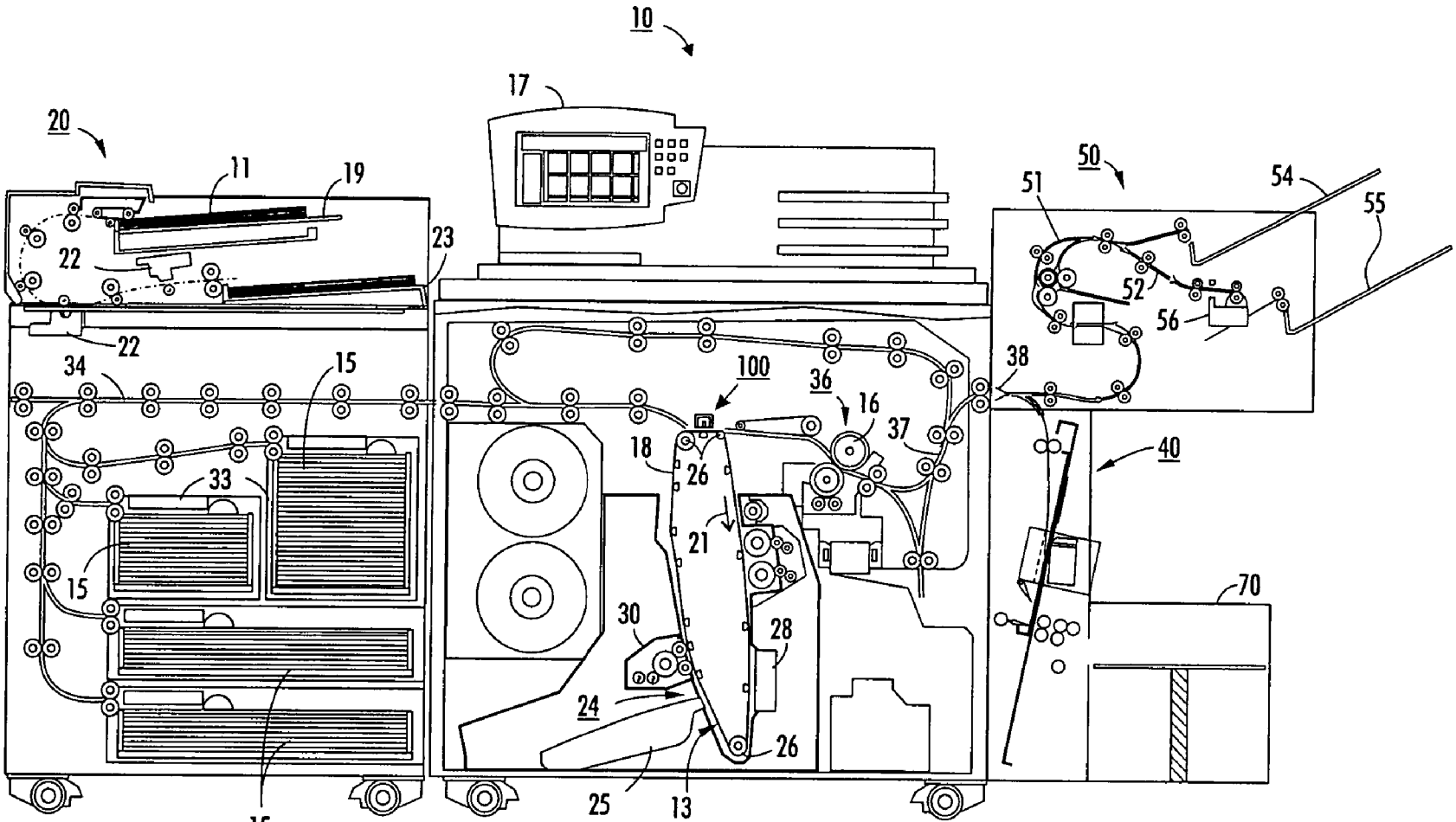
FIG. 1 is an exemplary elevation view of a modular xerographic printer that includes an exemplary corona generating device in accordance with the present disclosure.

While the disclosure is described hereinafter in connection with various embodiments thereof, the disclosure is not intended to be limited to these embodiments. On the contrary, all alternatives, modifications and equivalents are intended to be included within the spirit and scope of the disclosure as defined by the appended claims.

DETAILED DESCRIPTION

For a general understanding of the features of the disclosure, reference is made to the drawings. In the drawings, like reference numerals have been used throughout to identify like elements.

Referring to the FIG. 1, printer 10, as in other xerographic machines, and as is well known, uses an electronic document or an electronic or optical image of an original document or set of documents to scan a charged surface 13 of a photoreceptor belt 18 to form an electrostatic latent image. Optionally, an automatic document feeder 20 (ADF) may be used to generate an electronic document by scanning a document 11 at a scanning station 22 as the document is moved from a tray 19 to a tray 23. The machine user may enter desired printing and finishing instructions through the graphic user interface (GUI) or control panel 17, or, with a job ticket, an electronic print job description from a remote source, or by using another known method or device.

The belt photoreceptor 18 is mounted on a set of rollers 26. At least one of the rollers is driven to move the photoreceptor in the direction indicated by arrow 21 past the various other known xerographic processing stations, here a charging station 28, imaging station 24 (for a raster scan laser system 25), developing station 30, and a detack corotron 100, which is a corona charging device constructed in accordance with the present disclosure. The latent image on the photoreceptor belt 18 is developed with developing material at development station 30 to form a toner image corresponding to the latent image.

The toner image is electrostatically transferred to a final print media material, such as, a paper sheet 15. A sheet 15 is moved from a selected paper tray supply 33 for transfer of the toner image by a sheet transport 34. Paper trays 33 include trays adapted to feed the long edge of sheets first from a tray (LEF) or short edge first (SEF) in order to coincide with the LEF or SEF orientation of documents fed from tray 11 that is adapted to feed documents LEF or SEF depending on a user's desires. The toner image is transferred to the sheet and the sheet is stripped from the photoreceptor and conveyed to a fusing station 36 having a fusing device 16. The fusing device 16 permanently affixes the image to the sheet and then the substrate passes out of the nip at the fusing station 36. After separating from the fuser roll, the substrate is transported by a sheet output transport 37 to a multi-function finishing station 50.

With further reference to FIG. 1, a simplified elevation view of multi-functional finisher 50 is shown. Printed sheets from the printer 10 are directed to an entry port 38 for processing by the finisher 50. The various rollers and other devices that contact and handle sheets within finisher module 50 are driven by various motors, solenoids and other electromechanical devices (not shown), under a control system, such as including a microprocessor (not shown), within the finisher module 50, printer 10, or elsewhere, in a manner generally familiar in the art.

Multi-functional finisher 50 includes a top tray 54 and a main tray 55. The top tray 54 may be used as a purge destination, as well as, a destination for simple jobs that do not require finishing and/or collated stacking. The main tray 55 has a pair of pass-through, 100 sheet, upside down staplers 56 and is used for most jobs that require stacking or stapling. The booklet maker 40 is used to produce booklets, which may or may not be saddle stitched, and tri-folded sheets. The folding and booklet making module 40 adds staples for saddle stitched booklets, and performs C-fold and Z-fold operations for folded sheets. The finished booklets and folded sheets are then collected in a stacker 70. Conventional, spaced apart, staplers provide individual staple placement at either the inboard or outboard position of the sheets. Additionally, the staplers are capable of dual stapling, where a staple is placed at both the inboard and outboard positions of the same sheets.

Figure 2:
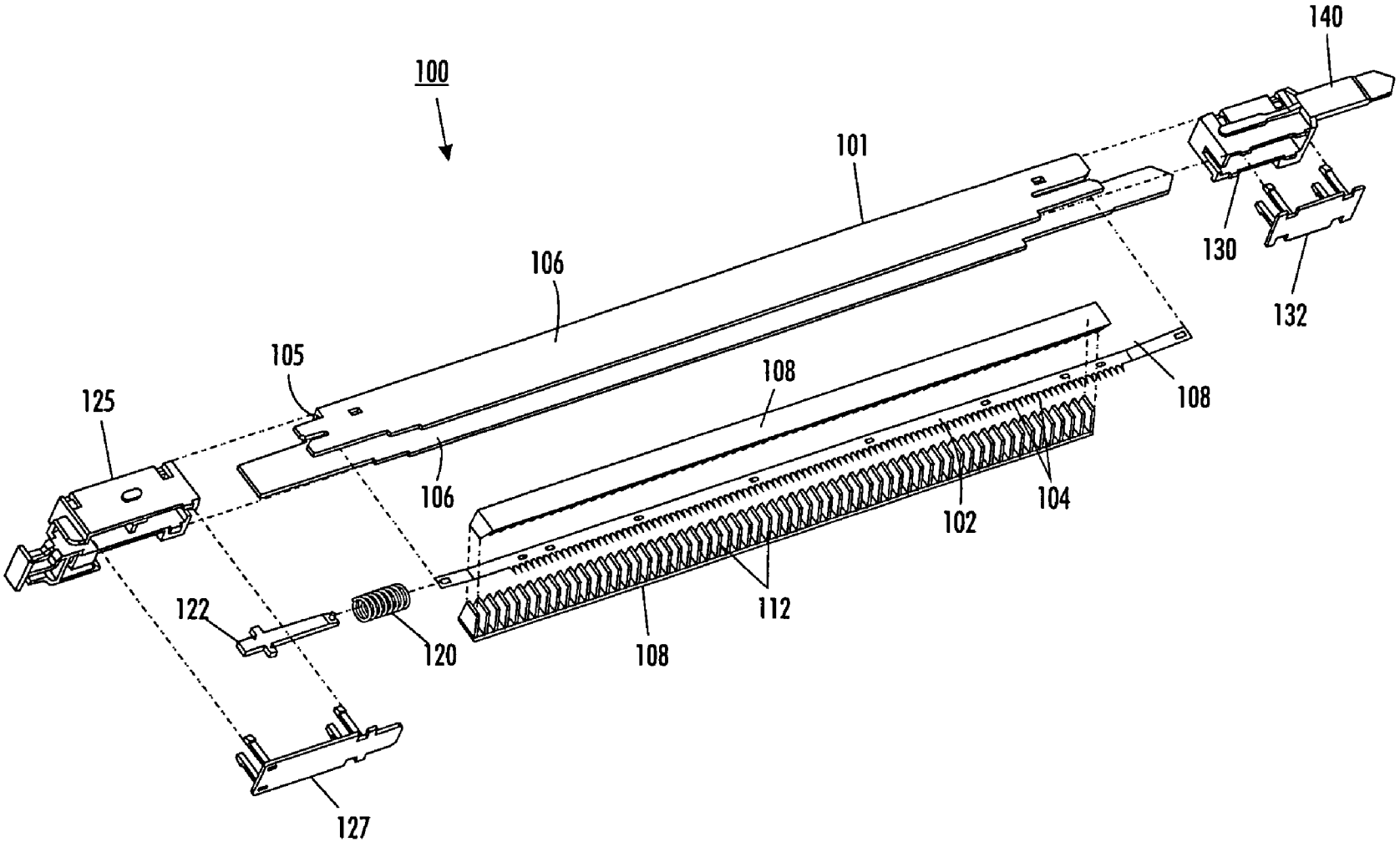
FIG. 2 is an expanded perspective view of the corona generating device of the present disclosure.

With reference to FIG. 2, an exemplary corona charging device representative of the specific subject matter of the present disclosure is illustrated and is described in greater detail. The structure of this corona charging device reduces the likelihood of curled sheet edges getting caught in the corona charging device and jamming the media path. The primary components of corona charging assembly 100 is pin coronode 102, a U-shaped corotron shield member 101, and a pair of paper guides 108. Pin coronode 102 comprises a thin, elongated member fabricated from a highly conductive material having triangular teeth or scalloped edges along one edge thereof and extending the entire length of the member. The triangular teeth or scalloped edges form an array of field emitters 104 that are directed towards a surface to be charged when the corona generating device is mounted within an imaging apparatus. Adjacent field emitters are spatially separated by the air gap between the teeth or edges. In one embodiment, the pin coronode 102 has a thickness of approximately 0.08 mm (0.003 inches) and the teeth in the array 104 extend approximately 3.5 mm (0.136 inches) and have a pin tip to pin tip interval of approximately 3 mm (0.12 inches).

A conductive corotron shield 101 includes a base member 105 and parallel sidewalls 106. Shield 101 is generally U-shaped and its opening is sized to accommodate the combined thickness of pin coronode 102 and paper guides 108 so the coronode 102 and the paper guides 108 are housed within the shield 101 in a close fitting arrangement.

Paper guides 108 have a length that parallels the coronode 102. Each guide 108 includes a plurality of generally planar members 112 that may be arranged in alignment as a row on each guide. The electrically conductive coronode 102 is interposed between the two guides 108.

A compression spring 120 is connected at one end to the outboard end of coronode 102 and to a tension holder 122. Protrusions of tension holder 122 mate with outboard end block 125 and are covered with outboard cover 127. Compression spring 120 provides tautness and stiffness to the pin array. While a compression spring is shown, the disclosure is not limited to compression springs since other springs could be use, for example, extension or leaf springs. The inboard end of coronode 102 is mounted within inboard end block 130 and enclosed with the cover 130. Pin coronode 102 is connected to a high-voltage extension member 140, or alternatively may be provided with an integral high-voltage extension member, for electrical connection of the pin coronode 102 to a high-voltage power source (not shown). In addition, clamping the paper guides 108 to the pin coronode 102 enables the coronode to float and be located by outboard and inboard end blocks 125 and 130, respectively.

Figure 3:
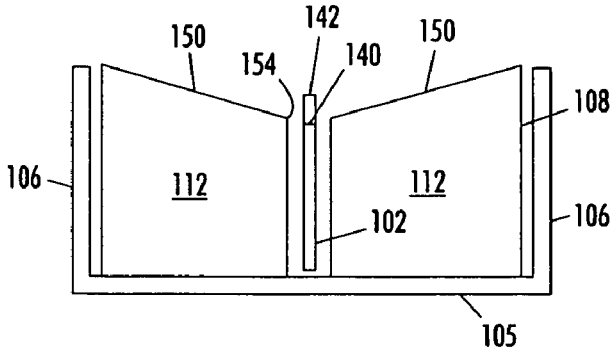
FIG. 3 is a side view of the corona generating device shown in FIG. 2.

A side view of the paper guides 108 and coronode 102 is shown in FIG. 3. As shown in the figure, the generally planar members 112 have a small gap between them and the outside edges of the coronode 102. In one embodiment, this gap is approximately 0.1 mm, although other gap distances may be used as appropriate. The members 112 have an upper surface 150 that slopes downwardly from its outside edge towards the field emitter 140 of coronode 102. The lower end 154 of the upper surface 150 is slightly taller than the terminating end 142 of field emitter 140. This height differential helps ensure that the terminating ends are not sufficiently exposed that someone reaching into the area of the corona generating device would be likely to engage them. This height differential, however, does not interfere with the ability of the terminating tip 142 to emit an electrostatic field that charges or discharges a sheet to facilitate image transfer as discussed above.

As shown in FIG. 3, the paper guides 108 and the coronode 102 are housed within the base 105 and side walls 106 of corotron shield 101 as previously discussed. Coronode 102 is mounted in the end blocks 125 and 130 as discussed above. Paper guides 108 may be mounted to the end blocks in a similar manner or they may be mounted to the base 105. In another embodiment, the paper guides 108 may be mounted to the side walls 106.

Figure 4:
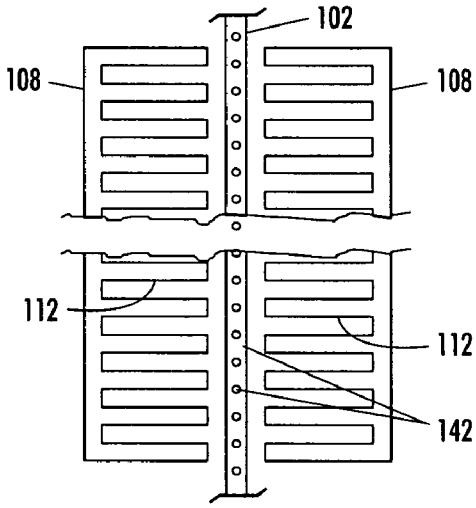
FIG. 4 is a top view of the corona generating device shown in FIG. 2.

FIG. 4 is a top plan view of the corona generating device shown in FIG. 2 depicting an arrangement of the generally planar members 112 to the terminating ends 142 of the field emitters 140. Coronode 102 is interposed between paper guides 108. The generally planar members 112 are essentially perpendicular to the coronode 102. In the figure, the planar members 112 are depicted in a staggered arrangement in which each member of the group of planar members associated with one of the paper guides 108 is aligned with a planar member in the group of planar members associated with the other paper guide 108. This alignment is denoted as being "staggered" because it is across the spatial separation between terminating ends 142 rather than being in alignment with the terminating ends 142. In an alternative embodiment, the planar members 112 may be aligned with the terminating ends. In yet another embodiment, the planar members 112 of one paper guide 108 may be aligned with the terminating ends 142 of the coronode 102 while the planar members 112 of the other paper guide 108 may be staggered with respect to the terminating ends 142.

Referring to the views of FIGS. 3 and 4, one can see that the planar members 112 on one side of the coronode 102 form a barrier to a paper edge moving into the area between the coronode 102 and one of the outer walls of the corotron shield 101. The other paper guide 108 performs a similar function on the other side of the coronode 102. Likewise, the terminating tips form a barrier row to a paper edge. Only a relatively small unobstructed gap exists between the coronode and the planar members of either paper guide. Therefore, the corona generating device shown in FIGS. 2-4 and the alternate embodiments described herein along with their equivalents substantially reduce the likelihood that a curled paper edge is caught in the corona generating device.

Figure 5:
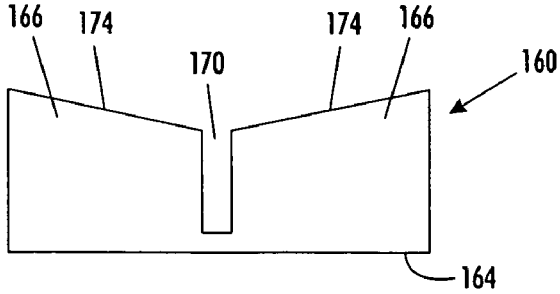
FIG. 5 is an alternative embodiment of the paper guide shown in FIG. 2.

FIG. 5 shows a side view of another embodiment of paper guide 108. In this embodiment, the structure of two separate paper guides has been integrated into a single member 160. A base portion 164 has a plurality of planar members 166 extending vertically from the base. A U-shaped gap 170 is formed between the planar members 166 arranged in a row on one side and the planar members 166 arranged on the other side. A coronode 102 may be located within this gap. The sloped surface 174 extends has a height that is above the terminating ends of field emitters on a coronode. Use of a paper guide such as the one shown in FIG. 5, enables a corona generating device to be made without using a corotron shield 101 to house the paper guides and coronode. In such an embodiment, the integral paper guide 160 may be mounted between the end blocks 125 and 130 in a manner similar to the mounting of the coronode to the end blocks.

While the planar members are shown as having a sloped upper surface, they may be generally rectangular or other geometric shapes. In a similar manner, various alternatives, modifications, variations or improvements may be subsequently made by those skilled in the art to the embodiments and examples presented above. Such alternatives, modifications, variations, and improvements are also intended to be encompassed by the following claims.

What is claimed is:

1. A corotron assembly comprising:
- a corotron shield having a base and parallel walls arranged in a U-shaped configuration;
- an electrically conductive coronode having a plurality of field emitters, each field emitter having a terminating end, the terminating ends of the field emitters being spatially separated from one another, the coronode being located within the U-shaped corotron shield; and
- a pair of paper edge guides, each guide having a plurality of generally planar members that are arranged in two groups, members of a first group of generally planar members are arranged in a row that parallels one side of the coronode and members of a second group of generally planar members are arranged in a row that parallels an opposite side of the coronode, each member of the first group of generally planar members are further arranged in the row to be aligned with a member of the second group of generally planar members on the opposite side of the coronode, each of the paper edge guides being configured to extend between one of the field emitters and one of the walls of the corotron shield and the generally planar members of the paper guides have a height that extends above the terminating ends of the field emitters.

2. The corotron assembly of claim 1 wherein an upper surface of the generally planar members of each paper edge guide has a slope.

3. The corotron assembly of claim 2 wherein the upper surface of the generally planar members slope downwardly from a position proximate one of the sidewalls of the corotron shield to a position proximate the terminating ends of the plurality of the field emitters.

4. The corotron assembly of claim 2 wherein each of the generally planar members has an upper sloping surface.

5. The corotron assembly of claim 4 wherein the upper surfaces of the generally planar members slope upwardly from a position proximate the terminating ends of the field emitters to a position proximate a side wall of the corotron shield.

6. The corotron assembly of claim 1 wherein each paper edge guide is separated from the coronode by a gap of approximately 0.1 mm.

7. An electrostatographic imaging machine comprising:
- a rotating photoreceptor onto which an image is generated;
- a media sheet transporter for moving a media sheet into proximity to the rotating photoreceptor;
- a corona charging device mounted proximate to the photoreceptor to emit an electrostatic field onto a surface of a media sheet contacting the photoreceptor, the corona charging device comprising:
  - a corotron shield having a base and parallel walls arranged in a U-shaped configuration, the corotron shield extending perpendicularly across a media sheet on the photoreceptor;
  - a coronode located within the U-shaped corotron shield, the coronode having a plurality of field emitters with terminating ends, the terminating ends of adjacent field emitters being spatially separated from one another; and a paper guide having a plurality of generally planar members that are arranged in two groups, members of a first group of generally planar members are arranged in a row that parallels one side of the coronode and members of a second group of generally planar members are arranged in a row that parallels an opposite side of the coronode, each member of the first group of generally planar members are further arranged in the row to be aligned with a member of the second group of generally planar members on the opposite side of the coronode, and each of the generally planar members extends between one of the field emitters and one of the walls of the corotron shield.

8. The machine of claim 7 wherein the alignment of the members in the first group of generally planar members with the members in the second group of generally planar members traverses the spatial separation between terminating ends of field emitters.

9. The machine of claim 8 wherein each of the generally planar members has a sloped edge.

10. The machine of claim 9 wherein the sloped edge terminates at a point that is higher than the terminating ends of the field emitters.

11. A corona charging device for use in an electrostatographic imaging machine comprising:

a corotron shield having a base and parallel walls arranged in a U-shaped configuration;

a coronode having a plurality of field emitters that are arranged in a row that parallels the walls of the corotron shield, each of the field emitters having a terminating end and the terminating ends of adjacent field emitters are spatially separated from one another; and a paper guide having a plurality of generally planar members, each of the generally planar members being between the coronode and one of the walls of the corotron shield and substantially perpendicular to the walls of the corotron shield, and the plurality of the generally planar members being arranged in two groups, the generally planar members of one group being arranged in a first row between the coronode and one of the walls of the corotron shield and the generally planar members of the other group being arranged in a second row between the coronode and the other wall of the corotron shield.

12. The corona charging device of claim 11 wherein each member in the first row of generally planar members is aligned with a member in the second row of generally planar members, the alignment of a member in the first row with a member in the second row traversing the spatial separation between terminating ends of field emitters of the coronode.

13. The corona charging device of claim 12 wherein each of the generally planar members has a sloped edge that terminates at a point that is higher than the terminating ends of the field emitters of the coronode.

* * * * *